US006139656A

United States Patent [19]

Wilkosz et al.

[11] Patent Number: 6,139,656

[45] Date of Patent: Oct. 31, 2000

[54] ELECTROCHEMICAL HARDNESS MODIFICATION OF NON-ALLOTROPIC METAL SURFACES

[75] Inventors: Daniel Edward Wilkosz, Ypsilanti; Matthew John Zaluzec, Canton, both of Mich.

[73] Assignee: Ford Global Technologies, Inc., Dearborn, Mich.

[21] Appl. No.: 08/499,849

[22] Filed: Jul. 10, 1995

[51] Int. Cl.[7] ..... C21D 1/09

[52] U.S. Cl. ..... 148/512; 148/522; 148/565; 204/164

[58] Field of Search ..... 148/512, 522, 148/565; 75/10.11; 204/164

[56] References Cited

U.S. PATENT DOCUMENTS

| | | | |
|---|---|---|---|
| 3,909,246 | 9/1975 | Cole et al. | 75/10.11 |
| 4,000,011 | 12/1976 | Sato et al. | 148/512 |
| 4,181,541 | 1/1980 | LeFrancois | 204/164 |
| 4,400,408 | 8/1983 | Asano et al. | 419/8 |
| 4,695,329 | 9/1987 | Hayashi et al. | 148/565 |
| 4,830,265 | 5/1989 | Kennedy et al. | 148/512 |
| 5,145,530 | 9/1992 | Cassady | 148/565 |
| 5,480,497 | 1/1996 | Zaluzec et al. | 148/512 |

FOREIGN PATENT DOCUMENTS

| | | | |
|---|---|---|---|
| 4308068 | 10/1992 | Japan | 148/512 |

*Primary Examiner*—George Wyszomierski
*Attorney, Agent, or Firm*—Joseph W. Malleck

[57] ABSTRACT

An electrochemical method of modifying the surface hardness of a non-allotropic metal member 10, comprising: (a) forming the member to near net-shape with at least one surface 12 to be hardened; (b) subjecting the surface 12 to rapid melting and resolidification by incidence of an electrical discharge between an electrode 16 and the surface 12 closely spaced thereto, the spacing containing an electrolyte with plasma forming capability, the surface 12 being hardened by crystallographic change of the globules resulting from substitutional alloying; and (c) cropping the surface grains 29 of the surface to increase load bearing capacity while retaining liquid retention capacity.

10 Claims, 3 Drawing Sheets

ELECTROCHEMICAL HARDNESS MODIFICATION OF NON-ALLOTROPIC METAL SURFACES

BACKGROUND OF THE INVENTION

1. Technical Field

This invention relates to technology for modifying the surface hardness of metal parts that have a near net-shape form, and more particularly to electrochemical techniques for achieving such hardness modification.

2. Discussion of the Prior Art

Selective surfaces of Ferrous based articles have been hardened by melting the surface with high energy, such as by electron bombardment, laser light, or plasma stream, and allowing the body of the Ferrous metal to chill the melted surface to produce a phase hardened surface. Metal surfaces have been hardened by thermal chemical treatment wherein molecules from an electrode or from a surrounding gas medium is impregnated into the metal surface. Surfaces have also been hardened by adhesion of superimposed films of harder material.

High energy beams are disadvantageous because they are difficult to regulate, expensive to operate and often require safety measures to protect the user. Thermal chemical treatments require a delicate and sophisticated energy producing apparatus in a tightly enclosed chamber which makes the system difficult to use and is expensive. Adherent layers of harder material often complicate and distort the near net-shape of the article so that it is more difficult to achieve an exact final shape of the article without increasing the cost of manufacturing.

Applicant is unaware of hardening of non-allotropic metals, such as aluminum, by electrochemical treatment wherein an electrical discharge across an insulative dielectric fluid causes globules of the non-allotropic metal surface to melt and upon removal of the electrical discharge, the globules are allowed to resolidify with alloying elements in the dielectric or metal surface forcing substitutional alloying and a harder surface. Applicant is aware of an electrochemical process, often referred to electrical discharge machining, that has been used to progressively remove surface metal from articles but with no attention to controlling hardness of the resulting work piece surface.

SUMMARY OF THE INVENTION

The invention, in a first aspect, is an electrochemical method of modifying the surface hardness of a non-allotropic metal member, comprising: (a) forming the member to near net-shape with at least one surface to be hardened; (b) subjecting the surface to rapid melting and resolidification by incidence of an electrical discharge between an electrode and the surface closely spaced thereto, the spacing containing an electrolyte with plasma forming capability, the surface being hardened by crystallographic change of the globules resulting from substitutional alloying or solid solution strengthening; and (c) cropping the surface grains of the surface to increase load bearing capacity while retaining liquid retention capacity.

The invention, in another aspect, is a unitary aluminum based swashplate member useful in a compressor, comprising: (a) a plate drivingly rotatable about an axis through its center but canted to the plane of the plate; (b) integral shoulders on opposite sides of the plate, each presenting a thrust surface for receiving a plurality of rolling bearing loads, the thrust surfaces being centered about such axis and being in a plane normal to such axis; and (c) each thrust surface having (i) a hardness enhanced thermochemically by electric discharge to a depth of 10–400 microns, and (ii) a surface roughness of 1.5 MmRa or less, the thrust surfaces being effective to substantially reduce the cost of swashplate fabrication and reduce load bearing failures.

DETAILED DESCRIPTION AND BEST MODE

Figure 1:
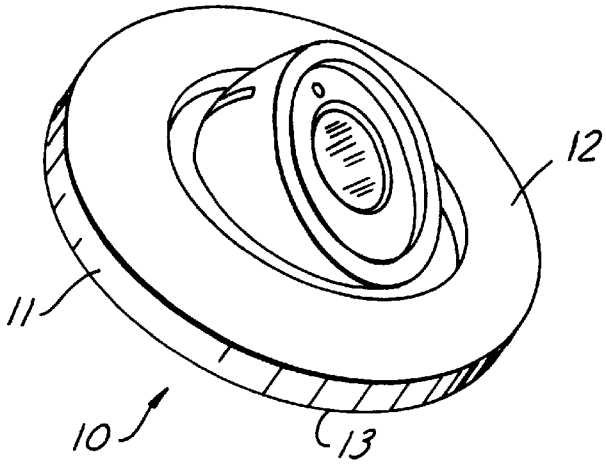
FIG. 1 is a perspective view of a compressor swashplate formed to near net-shape as the first step of the inventive process.
Figure 2:
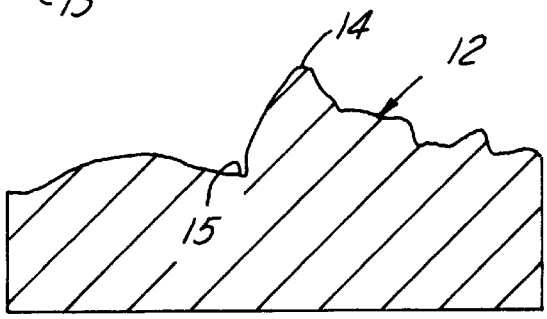
FIG. 2 is a highly enlarged schematic cross-section of the thrust bearing surface of the swashplate as a result of the first step.
Figure 3:
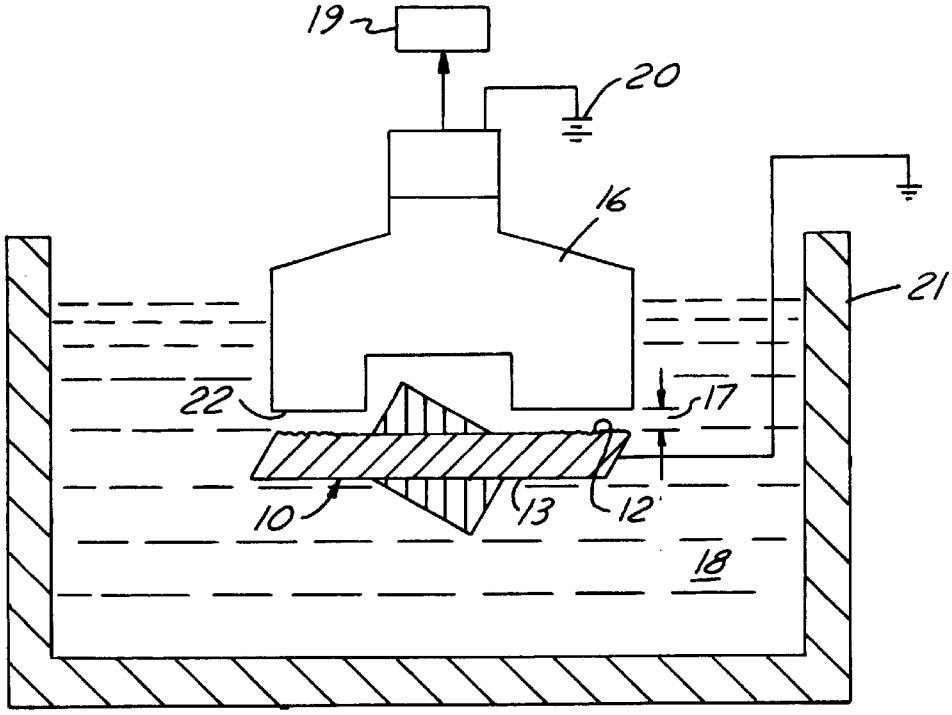
FIG. 3 is a schematic illustration of an apparatus for carrying out the second step of the inventive process.

The method of this invention comprises essentially three steps, the first of which is to form a metal member 10 of non-allotropic metal 11 to near net-shape with surfaces 12, 13 that will be subject to high rolling or rubbing stresses and therefore need to be hardened. Forming may be carried out by casting, machining from wrought bar stock, or by forging. As shown in FIG. 1, the member is a compressor swashplate formed from 390 aluminum alloy by forging. Near net-shape is used herein to mean that critical surfaces, such as 12 and 13, are substantially made to finish shape within 3.5 Mm. The starting roughness of such surfaces is usually about 2.0 MmRa, when forged, or about 1.0 MmRa when rough machined to near net-shape. As shown in FIG. 2, the surfaces will have peaks 14 and valleys 15 of substantial difference.

Non-allotropic metals include aluminum, magnesium and titanium. Such metals must contain alloying ingredients that are capable of promoting solution hardening by crystallographic change (the alloying ingredient straining the molecular matrix of the metal). For example, in aluminum, silicon, copper, magnesium, iron and manganese serve this purpose and may be present in cast aluminum alloys of 319, 390, 356, 357,380 and in wrought aluminum alloys of the 2000, 3000, 6000 and 7000 series. Such aluminum alloying ingredient should be present in an amount of at least 0.15% by weight and contain as much as 15% in some alloys. For magnesium, the ingredient can be Al, Zn, Mn, Si, Cu, Ni, or Fe; for titanium, the ingredient can be Al, V, Fe or Sn.

The starting surface hardness of such near net-shape member is about $R_b$ 40–55 when cast of aluminum or when rough machined from wrought aluminum. For a magnesium and titanium member, such hardness is about $R_b$ 35–45 and $R_b$ 65–75 respectively.

The second step of the process is to subject the surfaces 12 and 13 to rapid melting and resolidification by incidence of an electrical discharge between an electrode 16 and the surface 12 and 13 which is closely spaced thereto. The spacing 17 should contain an electrolyte 18 with plasma forming capabilities so that the surface can be hardened by crystallographic change of globules resulting from rapid melting and which globules undergo substitutional alloying or solid solution strengthening. One or more electrodes 16 are shaped complementary to the surfaces 12 and 13 and are arranged to be positioned within about 40 micrometers of such surfaces. The electrodes may be carried or manipulated by a robotic arm 19 to facilitate the rapid cycling of the electric discharge step. A suitable power supply 20 feeds electrical current to the electrodes 16 according to a programmed scheme. The medium of the electrolyte 18 fills the gap 17 existing between the electrodes and the surfaces to the modified. The electrolyte is introduced into the gap when the electrode is immersed in the liquid of tank 21. Thus, the necessary components for an electrical discharge to occur across the sparking gap 17, for purposes of this method, requires application of a DC voltage to a cathodic electrode, connecting the metal member 10 to act as an anode in the dielectric fluid; the dielectric fluid 18 can be deionized water with a typical conductivity of about 15 microsiemens. The deionized water may contain cations of hydrogen, sodium, calcium, magnesium, aluminum, iron and anions, such as hydroxides, chlorides, bicarbonates, carbonates, sulfates, nitrates and phosphates. Common contaminants in deionized water include sodium, silica, carbon dioxide and bicarbonate. It is usual to have metals present in deionized water such as iron, copper.

At the initiation of electric discharge, there is at first no electric current flowing between the anodic member surface 12 and the cothodic electrode surface 22. Current will pulse initially due to the insulation of the water dielectric in the gap 17. Within a few microseconds, an electric field will cause the micron impurities particles to be suspended and form a bridge across the gap 17 which then results in the breakdown of the dielectric. The voltage will fall to a lower level and the current will increase to a constant value as adjusted by the operator. Due to the emission of negative particles, a plasma channel will grow during the pulse "on" time. A vapor bubble will then form around the plasma channel and the surrounding dense water dielectric will restrict plasma growth, concentrating the input energy to a very small volume. The plasma temperature will reach very high levels, such as 40,000 k and the plasma pressure can rise to as much as a 3 k bar. There will be a melting-reshaping of metal globules at the surfaces 12 or 13 as a result of the reduced heat input after drop in the current period. As the current flow halts, the bubble implodes thereby distorting the molten globules without freezing them. The dielectric fluid solidifies this molten material by its temperature differential before such material can be carried away. The cycle is repeated during a subsequent "on" time of the current cycle.

Because of bombardment by fast moving electrons at the start of the pulse, the surface to be hardened as globules which will melt rapidly first but then begin to resolidify after a few microseconds.

To insure the conditions for hardness enhancement, the voltage promoting the electrical discharge should be in the range of 5–10 volts max., the amperage should be in the range of 3–20 amps, and the discharge pulse should be "on" for periods of 200–1000 microseconds. The duration over which the hardening treatment is carried out is usually about 0.5–2 minutes. The voltage/amp period is kept considerably lower than that used for roughening or for electrical discharge machining. The depth of hardness can be varied with a slight increase in voltage and pulse.

Figure 4:
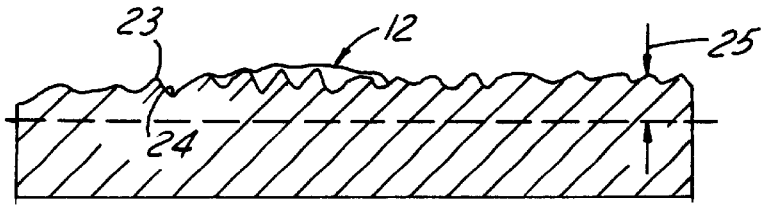
FIG. 4 is a highly enlarged schematic cross-section on the same scale as in FIG. 2, showing the condition of the thrust surface after the second step of the process.
Figure 5:
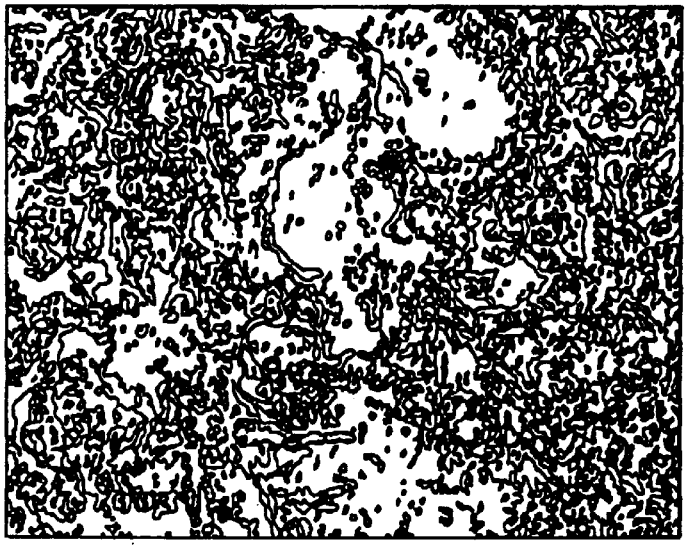
FIG. 5 is a representation of a scanning electron micrograph of a plan view of the thrust bearing surface after the second step of the process.
Figure 6:
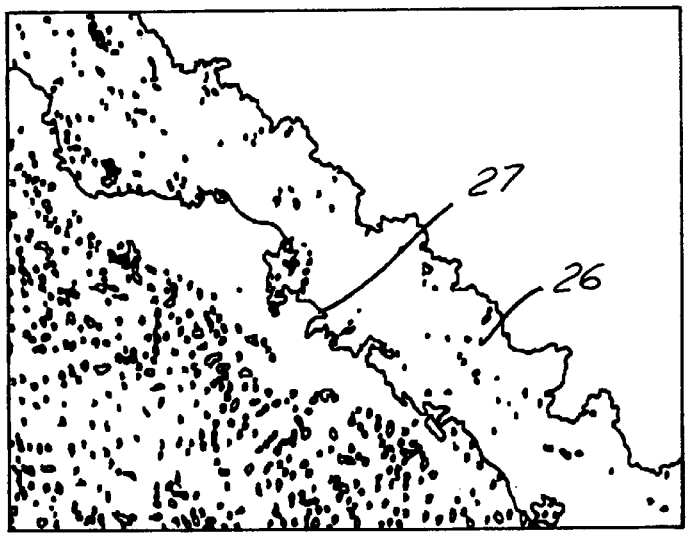
FIG. 6 is a representation of a scanning electron cross-section micrograph of the same surface as in FIG. 5.

As the result of the second step, the surface 12 treated by the electrical discharge will have a smoother, but undulating profile as shown in FIG. 4. New peaks 23 and new valleys 24 are reduced by relocation of the melting and rapid resolidification. The affected surface, to a depth 25, will be enhanced in hardness to about $R_b$ 65–80. Roughness can be tailored by manipulating voltage, amperage pulsation, or the electrical discharge process. Evidence of more uniformity in the surface character of the affected swashplate is shown in the scanning electron micrographs of FIGS. 5 and 6. FIG. 5 shows the surface uncoated as resulting from electric discharge. FIG. 6 is a sectional scanning electron micrograph of a coated surface previously subjected to electric discharge showing the depth of the affected layer to be 200–900 microns deep. A high degree of mechanical interlock takes place between the coating 26 and the cropped electrically discharged and chemically modified surface 27.

Figure 7:
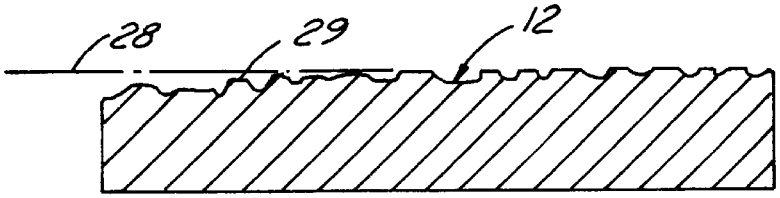
FIG. 7 is a highly enlarged cross-section, on the same scale as in FIG. 2, showing the condition of the thrust bearing surface after the third step of the process.

The third step of the process is to crop along a plane 28 the surface grains 29 of the surface 12 to increase its load bearing capacity, as shown in FIG. 7. This may be carried out by honing, using a diamond flat wheel that crops the tops of the peaks of the surface grains. The surface roughness will be reduced to 1.5 Ra or less without affecting the hardness previously imparted as a result of the electrical discharge treatment.

Figure 8:
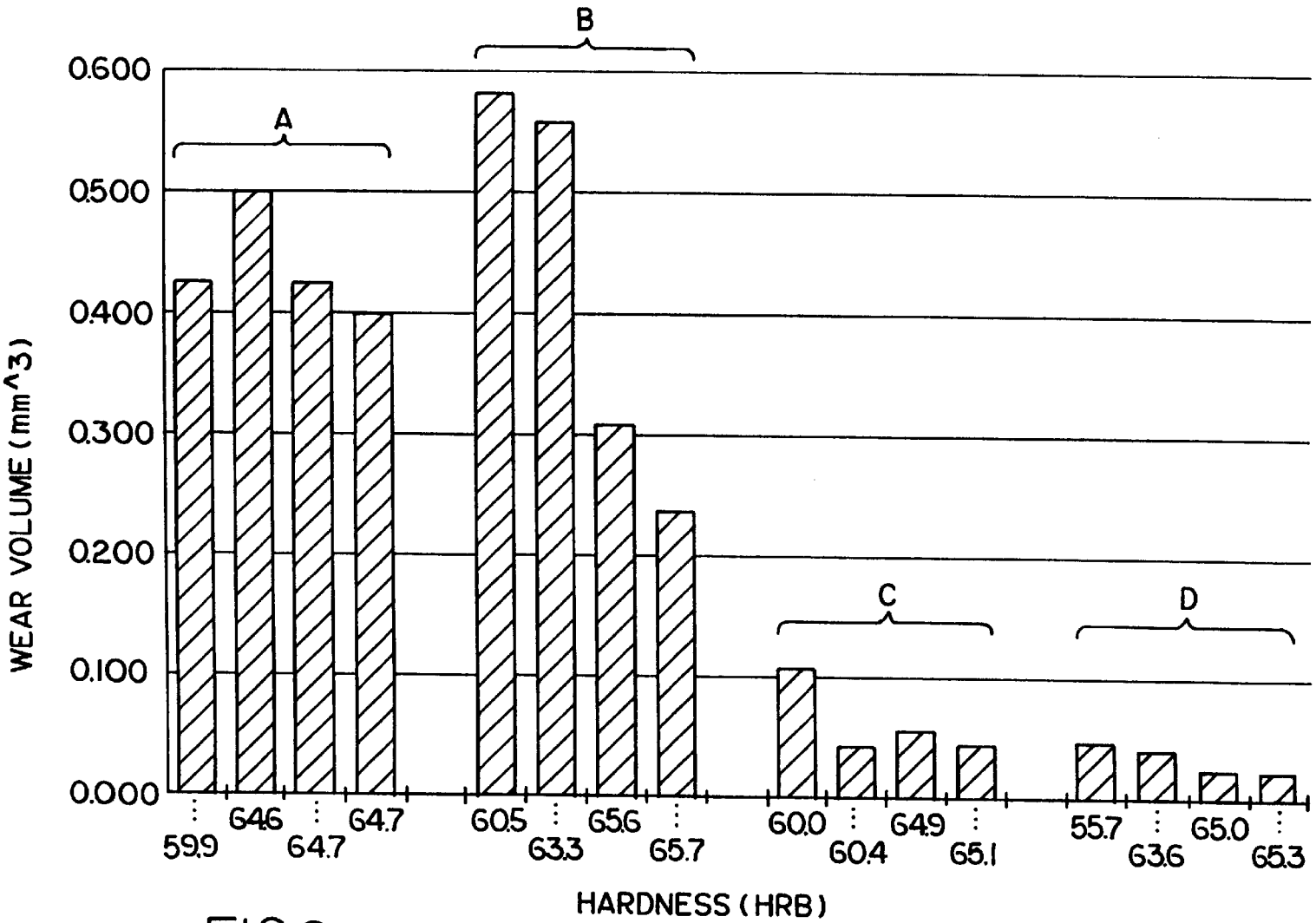
FIG. 8 is a bargragph showing the variation of swashplate worn area volums as a function of resulting hardness for differing heat thermochemically treated specimens under two differing loading conditions.

The wear characteristic of a 357 aluminum alloy member can be determined by subjecting the member to a block on ring wear test. The resulting data is shown in FIG. 8 wherein Group A bars represent wear volumes for specimens that were subjected to a dry wear test at 36,000 psi, and Group B bars represent specimens subjected to a lubricated wear test at 36,000 psi. Group C bars represent specimens subjected to a dry wear test at 10,000 psi, and Group D bars represent specimens subjected to a lubricated wear test at 10,000 psi. The wear data for lubricated Group B specimens decrease significantly as the hardness is increased. Groups C and D are for specimens that were both run dry and lubricated under a 10,000 psi load; under this lighter loading, the increase in hardness of the specimen again shows a definite trend towards reduction of wear whether it be dry or lubricated.

The resulting new product, such as a compressor swashplate, possesses several new advantages. First, the swashplate product may eliminate failure due to galling and sliding wear. Secondly, the cost of making the compressor swashplate is substantially reduced as a result of surface hardening from the electrical discharge process when compared to conventional hard coating applications used to prevent wear. In operative use, such as shown in the partial compressor assembly in FIG. 9, the swashplate 10 is rotatably drivingly mounted about an axis 30 through its center that is canted to the plane 31 of the plate. Shoes 32,33 on opposite sides of the plate have a plurality of seats 34 each cradling a bearing 35 which present a rolling or sliding load on the thrust surfaces 12 or 13 centered about axis 30. The thrust surfaces have a hardness enhanced thermochemically by electric discharge to a depth of about 100 Mm and each have a surface roughness of 1.5 MmRa or less. The thrust surfaces are effective to substantially reduce the cost of swashplate fabrication and reduce load bearing failures.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. An electrochemical method of modifying the surface hardness of a non-allotropic metal member comprising:

(a) forming said member to near net-shape with at least one surface to be hardened;

(b) subjecting said surface to rapid melting and resolidification by incidence of a plasma of an electrical discharge between an electrode and said surface which is closely spaced thereto, the spacing containing a dielectric fluid with plasma forming capabilities, the surface being hardened by crystallographic change of the globules resulting from substitutional alloying or solid solution strengthening; and (c) cropping the surface grains of said surface to increase load bearing capacity while retaining liquid retention capacity.

2. The method as in claim 1, in which the hardness of said treated surface is increased by at least 25 HK.

3. The method as in claim 1, in which the electrical discharge is carried out at low voltage and amperage.

4. The method as in claim 1, in which the depth of surface hardening is increased by increasing the voltage and the pulse period of said electrical discharge.

5. The method as in claim 1, in which the discharge of step (b) is carried out with a voltage in the range of 5–20 volts and the discharge being pulsed for periods of 200–1000 microseconds.

6. The method as in claim 1, in which the roughness of the cropped hardened surface is 1.5 MmRa or less.

7. The method as in claim 1, in which said metal member is selected from the group consisting of titanium, magnesium and aluminum.

8. The method as in claim 7, in which said metal is aluminum selected from the group consisting of cast aluminum alloys 319, 390, 356, 357, 380 and wrought aluminum alloys of the 2000, 3000, 6000 and 7000 series.

9. The method as in claim 1, in which said member is constituted of a metal with substitutional alloying ingredient present therein.

10. An electrochemical method of modifying the surface hardness of a non-allotropic metal member comprising:

(a) forming said member to near net-shape with at least one surface to be hardened;

(b) subjecting said surface to rapid melting and resolidification by incidence of an electrical discharge between an electrode and said surface which is closely spaced thereto, the spacing containing an electrolyte with plasma forming capabilities, the surface being hardened by crystallographic change of the globules resulting from substitutional alloying or solid solution strengthening; and (c) cropping the surface grains of said surface by diamond flat honing to increase load bearing capacity while retaining liquid retention capacity.

* * * * *